US006506697B1

(12) United States Patent
Samel

(10) Patent No.: US 6,506,697 B1
(45) Date of Patent: Jan. 14, 2003

(54) TIGHTLY WOVEN PAPER TEXTILE PRODUCTS

(75) Inventor: Hiram M. Samel, Boston, MA (US)

(73) Assignee: Merida Meridian, Inc., Boston, MA (US)

( * ) Notice: Subject to any disclaimer, the term of this patent is extended or adjusted under 35 U.S.C. 154(b) by 0 days.

(21) Appl. No.: 09/368,766

(22) Filed: Aug. 5, 1999

(51) Int. Cl.[7] ..... B32B 27/00

(52) U.S. Cl. ..... 442/286; 42/86; 42/148; 42/153; 42/208; 42/209; 42/226; 42/295; 139/420 B; 427/391

(58) Field of Search ..... 442/286, 295, 442/208, 209, 226, 86, 153, 148; 139/420 B; 427/391

(56) References Cited

U.S. PATENT DOCUMENTS

| | | | | | |
|---|---|---|---|---|---|
| 39,556 | A | | 8/1863 | Dunkin | 139/420 B |
| 280,286 | A | | 6/1883 | Bray | 139/420 B |
| 342,988 | A | | 6/1886 | Wyman | 139/420 B |
| 828,784 | A | | 8/1906 | Stevenson | 139/420 B |
| 1,219,958 | A | | 3/1917 | Kron | 242/471 |
| 1,556,175 | A | | 10/1925 | Stevenson | 139/420 B |
| 1,765,512 | A | | 6/1930 | Waite | 139/420 B |
| 1,795,838 | A | | 3/1931 | Cramer et al. | 139/420 B |
| 1,829,299 | A | | 10/1931 | Rosenstein | 139/420 B |
| 1,897,671 | A | | 2/1933 | Millett | 139/420 B |
| 1,941,836 | A | | 1/1934 | Hillard | 66/190 |
| 1,969,855 | A | | 8/1934 | Richter et al. | 139/420 B |
| 1,995,696 | A | | 3/1935 | Wallach | 57/235 |
| 2,026,693 | A | | 1/1936 | McLean | 139/420 B |
| 2,065,517 | A | | 12/1936 | Dreyfus et al. | 66/202 |
| 2,078,414 | A | | 4/1937 | Sackner et al. | 139/389 |
| 2,123,438 | A | | 7/1938 | Sackner et al. | 139/389 R |
| 2,168,696 | A | | 8/1939 | Beck | 139/425 B |
| 2,245,540 | A | | 6/1941 | Barr | 139/425 R |
| 2,418,215 | A | | 4/1947 | Lambert | 139/420 B |
| 2,492,670 | A | | 12/1949 | Underwood | 139/401 |
| 2,557,819 | A | | 6/1951 | Fischer et al. | 139/385 |
| 2,590,995 | A | | 4/1952 | Merrill | 139/416 |
| 2,734,532 | A | | 2/1956 | Light | 139/420 B |
| 2,787,045 | A | | 4/1957 | Crawford | 28/169 |
| 2,901,005 | A | | 8/1959 | Schwartz | 139/420 B |
| 2,929,414 | A | | 3/1960 | Lienhard | 139/420 B |
| 2,939,200 | A | | 6/1960 | Ewing et al. | 139/420 B |
| 3,344,970 | A | | 10/1967 | Brandes | 229/4.5 |
| 4,468,254 | A | * | 8/1984 | Yokoyama et al. | 106/271 |
| 5,074,873 | A | | 12/1991 | Dioguardi | 606/203 |
| 5,336,700 | A | | 8/1994 | Murray | 523/116 |
| 5,832,962 | A | | 11/1998 | Kaufman et al. | 139/383 A |

OTHER PUBLICATIONS

Brochure: Merida Textures, Merida Meridian, Inc., Boston, MA, copyright 1999.
Brochure: Merida Naturals, Merida Meridian, Inc., Boston, MA, copyright 1999.
Brochure: Merida Paper, Merida Meridian, Inc., Boston, MA, copyright 1998.

* cited by examiner

*Primary Examiner*—Terrel Morris
*Assistant Examiner*—John J. Guarriello
(74) *Attorney, Agent, or Firm*—Wolf, Greenfield & Sacks, P.C.

(57) ABSTRACT

The present invention provides a textile material comprising a tightly woven paper fabric having a backing applied on only one side. The tight weave allows the backing to be applied as a liquid, whereupon curing cause the liquid to harden. The backing confers additional strength and durability to the paper fabric and allows mass production of paper fabrics by the formation of a continuous sheet that can be cut to desired dimensions and shapes without fraying at the edges. The present invention also provides methods for forming tightly woven fabrics and for applying a backing onto this fabric.

50 Claims, 2 Drawing Sheets

TIGHTLY WOVEN PAPER TEXTILE PRODUCTS

FIELD OF INVENTION

The present invention relates to a textile materials and more particularly, to paper fabrics, methods for weaving such fabrics, and methods for applying a backing onto only one side of the fabric.

BACKGROUND OF THE INVENTION

There is currently a large demand for environmentally-friendly consumer products arising from an increasing environmental consciousness. This demand extends to home furnishings comprising natural materials. In addition to being aesthetically pleasing, consumers generally insist that these natural products possess sufficient strength and durability for long-term use, as well as being environmentally friendly.

In particular, the demand for paper products is high because paper is typically viewed as an all-natural material. Many paper articles of manufacture include hats, bags, and rugs. Paper durability and strength increase if paper is woven. These articles have a loose weave because stiffness of the paper hampers the weaving process.

Many manufacturers have incorporated other materials into the paper fabric to strengthen the resulting product. For example, U.S. Pat. No. 2,929,414 describes a woven fabric having a mixture of paper yarns and saran filaments. In particular, the fabric has a saran warp and a paper weft. U.S. Pat. No. 2,939,200 describes coating individual cellulosic yarn filaments with a plasticizer such as polyvinyl chloride for increased strength of the yarn and resulting fabric. Several patents, e.g., U.S. Pat. Nos. 1,829,229, 1,995,696 and 2,557,819 describe fabrics comprising synthetic cellulosic materials. These synthetic cellulosic materials provide a fabric with greater strength than a naturally-occurring paper fabric.

Thus, it remains a challenge to prepare fabrics comprising paper materials.

SUMMARY OF THE INVENTION

One aspect of the present invention provides a textile material. The material comprises a fabric comprising a first set of paper yarns in a warp direction woven with a second set of paper yarns in a substantially perpendicular weft direction. A backing is positioned adjacent one side of the fabric. The fabric may be tightly woven.

Another aspect of the present invention provides a fabric comprising a first set of paper yarns in a warp direction tightly woven with a second set of paper yarns in a substantially perpendicular weft direction.

Another aspect of the present invention provides a method of producing a textile material. The method involves forming a fabric by tightly weaving a first set of paper yarns in a weft direction with a second set of paper yarns in a substantially perpendicular weft direction. The method also involves applying a backing on one side of the fabric to form the textile material. Tightly weaving may comprise weaving the yarns with a wide loom. The applying may comprise introducing a liquid onto one side of the fabric and curing the liquid.

Another aspect of the present invention provides a method of weaving a paper fabric. The method involves providing paper yarns and weaving the paper yarns on a wide loom.

Another aspect of the present invention provides a textile material. The material comprises tightly woven paper yarns having a polymer precursor positioned on one side of the fabric and an opposing side of the fabric free of the precursor.

Another aspect of the present invention provides a textile material. The material comprises tightly woven paper yarns having a liquid having a viscosity of at least about 50 centipoise positioned on one side of the fabric and an opposing side of the fabric free of the liquid.

Another aspect of the present invention provides a textile material comprising a woven paper fabric having a latex backing positioned on one side.

Another aspect of the present invention provides a textile material. The material comprises a tightly woven material capable of having a viscous liquid positioned on one side and an opposing side free of the viscous liquid.

Other advantages, novel features, and objects of the invention will become apparent from the following detailed description of the invention when considered in conjunction with the accompanying drawings, which are schematic and which are not intended to be drawn to scale. In the figures, each identical or nearly identical component that is illustrated in various figures is represented by a single numeral. For purposes of clarity, not every component is labeled in every figure, nor is every component of each embodiment of the invention shown where illustration is not necessary to allow those of ordinary skill in the art to understand the invention.

DETAILED DESCRIPTION

Figure 1A:
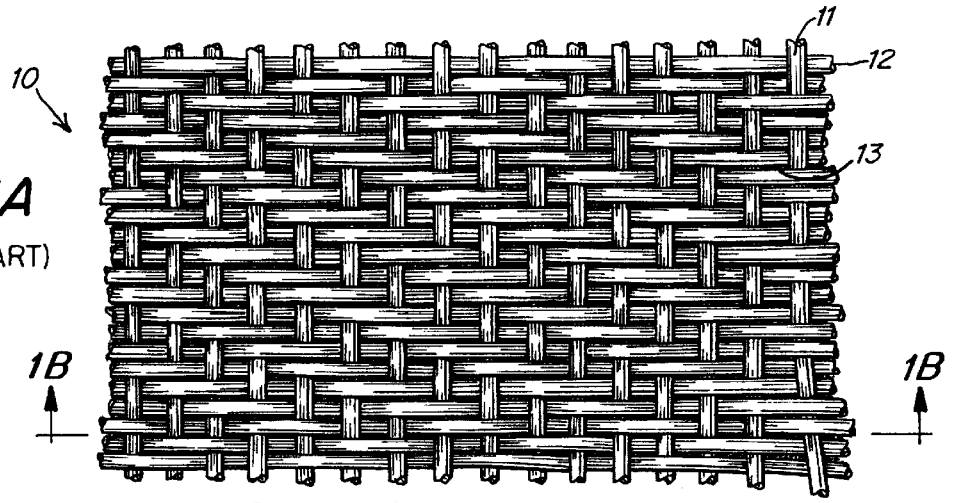
Fig. 1A (PRIOR ART)
FIG. 1A shows a top view of a prior art paper carpet drawn to scale.
Figure 1B:
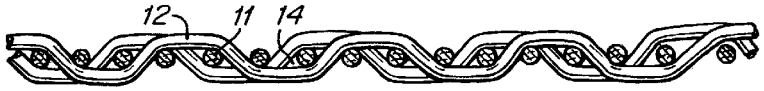
Fig. 1B (PRIOR ART)
FIG. 1B shows a side view of the prior art carpet fabric of FIG. 1A drawn to scale.

The present invention relates to tightly woven textile products made from paper yarns. The ability to tightly weave paper yarns allows the application of a plastic backing on one side of the textile. This backing provides enhanced strength and durability to the paper textile product and provides advantageous benefits such that the textile can be cut to a desired shape or size without fraying.

Paper is viewed as being a substantially all-natural material, a factor which contributes to the popularity of paper particularly among people who desire an environmentally-friendly product. The average person, however, does not view paper as a durable product, as many paper materials are easy to tear or become fragile and brittle over time. Processing a durable paper product thus presents a challenge for manufacturers.

Paper durability and strength increase if paper is woven. Preparing woven paper fabrics, such as rugs, presents an additional challenge, however, because a paper yarn has to be produced and successfully woven into a material that does not easily tear, fray or result in displacement of individual strands. In addition, paper is a stiff material. To weave paper, a balance must be achieved by providing a yarn thick enough to provide the woven material with sufficient strength, yet possessing sufficient flexibility to allow tight weaving. Generally, flexibility can only be obtained with a relatively thin paper yarn. Thin yarns, however, can result in a decreased strength of the woven fabric.

One aspect of the present invention provides a textile material comprising a woven fabric and a backing positioned adjacent one side of the fabric. The fabric comprises a first set of paper yarns in a warp direction and a second set of paper yarns in a weft direction. Preferably, the warp and weft directions are tightly woven substantially perpendicular with respect to each other. Examples of fabrics include home furnishings such as wall hangings, curtains, mats and carpets, or any other fabric capable of being prepared from woven paper yarns. Application of the present invention to carpets and rugs is particularly significant, since the demands placed on carpets and rugs during use are high.

In one embodiment, the fabric is tightly woven. "Tightly woven" refers to a relatively high density of yarns in the warp and weft directions, i.e., number of yarns per length of fabric. A low density of paper yarns would result in a loosely woven material, such that relatively large gaps and spaces result between individual yarns. A "tightly woven" fabric leaves gaps sufficiently small that a liquid backing may be applied, such as applying a latex backing. In one embodiment, a tightly woven product comprises a density of the first set of yarns (warp direction) of at least about 6 ends/in. In one embodiment, a tightly woven fabric comprise a density of the second set of yarns (weft direction) of at least about 6 picks/in. and more preferably at least about 10 picks/in.

In yet another embodiment, a sum of the density of the first and second set of yarns is at least about 20 yarns/in. By this embodiment, the first and second set of yarns are not necessarily present in equal densities. Yarn densities generally depend on the weave pattern and can be chosen by one of ordinary skill in the art.

A feature of the present invention is that the fabric comprises paper products. "Paper" is the product of processing cellulose fibers in which "cellulose" refers to a naturally occurring polysaccharide. Cellulose can include polysaccharides of any degree of polymerization. For example, cellulose generally refers to a material having a high degree of polymerization such as α-cellulose. Cellulose fibers having lower degree of polymerization are known as a "hemicellulose", alternatively known as β-cellulose and γ-cellulose. The paper yarn can also include other natural products. According to certain embodiments of the present invention, the amount is preferably less than about 50% and more preferably less than about 25%. Examples of other natural products include lignins, a polymer which naturally occur together with cellulose in "woody" parts of plants, such as shrubs and trees. A "paper" product includes substantially all paper and other natural fibers. An "all-natural paper product" is a paper product which includes no synthetic materials.

According to some embodiments of the present invention, paper yarns having a sufficient strength to result in a durable woven product are used. Yarns may be prepared by twisting paper. Water can be added to wet the paper which can aid the twisting process. Preferably, the paper prior to wetting is chosen to have sufficient strength to withstand the twisting and to produce a strong yarn. In one embodiment, the paper has a basis weight average of at least about 20 lb. In one embodiment, the paper has a machine direction tensile strength of at least about 20 lbs/in. and a minimum cross machine direction tensile strength of at least about 5 lbs/in. In one embodiment, the paper prior to wetting does not display a high amount of elasticity and has a maximum stretch of less than about 5% and more preferably less than about 2%. In one embodiment, once the paper has been wetted, the paper has a wet strength of at least about 5%, more preferably at least about 6%, even more preferably at least about 7%, even more preferably at least about 8% and even more preferably still at least about 9%.

Once the paper is twisted, preferably a resulting yarn has a minimum tensile strength of at least about 15 lbs. To achieve yarns of the appropriate dimensions to allow a tightly woven product, the yarn should have a minimum twist of at least about 20 twists/ft, more preferably at least about 25 twists/ft. These parameters can result in a yarn having a thickness, or circular mill value, of less than about 6,000, and more preferably between about 4800 and about 5800. Preferably, the resulting yarn has a density of less than about 1500 ft of yarn/lb of paper, more preferably less than about 1300 ft yarn/lb of paper and more preferably between about 900 and about 1300 ft of yarn/lb of paper.

When a tightly-woven paper fabric is prepared, a backing may be positioned adjacent one side of the fabric. Advantages of a backing include extra strength and durability conferred to the fabric especially where the fabric is a carpet that is subjected to many mechanical stresses.

Additionally, previous processes for producing paper fabrics involved preparing each paper fabric individually to a predetermined size. A more efficient process of mass-producing paper fabrics would preferably involve providing large continuous sheets of paper fabric and cutting the paper fabric to a predetermined size. This process is generally not feasible because cutting woven paper yarns would typically lead to fraying of the edges of the fabric. A backing can help maintain the integrity of the cut edges and substantially prevent the extent of fraying. Thus, a backing allows and/or eases mass-production of paper fabrics via formation of large continuous sheets and cutting the sheets to a predetermined size and shape.

According to this embodiment of the present invention, a backing may be positioned on only one side of the fabric. Thus, an opposing side, i.e., the visible side, may be free of the backing, which confers the look and feel of a paper product.

In one embodiment, the backing is a plastic backing. In a preferred embodiment, the backing comprises a polymeric material. In yet another preferred embodiment, the polymeric material is a latex. Examples of such latex polymers include synthetic latexes such as polystyrene, styrene-butadiene copolymers, polyacrylates, polyvinylacetates, polyamides, acrylonitryl-butadiene styrene (ABS), copolymers of these and physical blends of these. The latex can also be a natural rubber latex, such as a latex comprising at least 50% of natural rubber. The backing can also comprise blends and/or copolymers of natural and synthetic latexes.

The plastic backing can also include a minority of additives. These additives include dispersing agents, stabilizers such as soap, chalk, antioxidants, vulcanization agents, and gelling agents.

In one embodiment, a laminate is applied on a side of the backing opposite the fabric, where the backing is sandwiched between the laminate and the fabric. By this embodiment, the manufacturer can apply an aesthetically pleasing laminate to cover the backing. Laminates can comprise various materials well-known in the art, such as materials supplied by Tasibel NV of Belgium.

In one embodiment, the backing can be applied via extrusion, i.e. a polymer is extruded onto the fabric by any extrusion method known in the art. In one embodiment, the backing comprises a polyalkylene, such as polyethylene and polypropylene.

The textile material with backing may be cut to any desired dimension or shape, where the newly cut edges are free of fraying. In one embodiment, to further strengthen the edge, a border can be positioned along at least one edge of the textile material. The border may cover the termini of the yarns to prevent fraying. The border can comprise any number of known border materials, such as cloth, paper, plastic or leather, among others. Preferably, the border is applied along at least two opposing edges of the material if the material is cut as a square or rectangular shape. If the material is circular, the border can be applied along the circumference. Of course, any amount or style of border can be applied as desired.

Certain embodiments of the present invention provide a tightly woven paper fabric. The fabric comprises a first set of paper yarns in a warp direction woven with a second set of yarns in a substantially perpendicular weft direction. In this embodiment, each set of yarns have a density in which a sum of each density is at least about 20 yarns/in. As described previously, a density in the warp direction is preferably at least about 6 ends/in. A density in the weft direction is preferably at least about 6 picks/in. and more preferably at least about 10 picks/in. The density can be chosen to achieve a tight weave, based on the particular weave pattern.

A textile material such as those described above may be produced according to the following method. The method involves formation of a fabric by tightly weaving paper yarns followed by applying a backing on one side of the fabric.

In one embodiment, the backing is applied as a liquid which can be cured to harden, thus forming the final backing product. In one embodiment, the liquid is a viscous liquid having a viscosity of at least about 50 centipoise, more preferably at least about 100 centipoise and more preferably at least 500 centipoise.

In one embodiment, the backing is applied by introducing a liquid onto one side of the fabric followed by hardening the liquid. "Introducing a liquid" can involve any process such as pouring the liquid, spreading the liquid, injecting the liquid, spraying the liquid or any other technique that results in the liquid substantially covering all of one side of the fabric.

Where the backing is a latex backing, in one embodiment, the liquid is a precursor of a latex. Generally, latexes are prepared by curing a precursor solution or emulsion that can include monomers or oligomers capable of polymerization.

Thus, in one embodiment, hardening involves polymerization of the precursor solution or emulsion. Polymerization can occur by any method of curing, e.g., air drying, heating, applying a pressure, exposure to light, or any combination of these curing conditions. In one embodiment, the final polymer has a viscosity of at least about 1,000 centipoise and more preferably, at least about 5,000 centipoise.

In one embodiment, the liquid is hardened immediately after introducing the liquid. By this embodiment, the speed of manufacturing the textile material is increased. This increased speed also minimizes the likelihood that the liquid will slowly leak to the other side of the fabric. In one embodiment, after introducing the liquid to one side of the backing, the liquid is immediately exposed to curing conditions, as described previously. Preferably, the liquid is subjected to curing conditions within five minutes of introduction, more preferably within two minutes and even more preferably within one minute.

In one embodiment, an opposing side of the fabric is free of the liquid. Due to the tight weave of the fabric, the liquid is incapable of penetrating through the fabric to the other side under the conditions imposed during the curing process. This embodiment differs from certain prior art paper fabrics in which the loose weave allows the liquid to seep through gaps between individual yarns. With certain loosely woven prior art fabrics, introducing a liquid on one side would result in at least one individual yarn having at least a portion of the opposing visible side coated with the liquid, i.e. the liquid leaks through the fabric.

It can be seen that the tight weave is particularly advantageous for applying a liquid onto one side of the fabric without the liquid leaking through gaps and penetrating through to the other side of the fabric. A fabric allowing this penetration would suffer disadvantageous effects of a less than desired amount of backing on the appropriate side, and unsightliness of the finished textile product where the desired "clean" side has splotches of the backing material in the areas surrounding the gaps.

Thus, a textile material comprising tightly woven paper yarns, having a viscous liquid positioned on one side of the fabric where an opposing side of the fabric is free of the precursor, is a particularly useful product. In one embodiment, the fabric is capable of having a viscous liquid positioned on one side wherein the other side is free of the viscous liquid. In one embodiment, the viscous liquid is a polymer precursor. In another embodiment, the viscous liquid is a liquid having a viscosity of at least about 50 centipoise, or other viscosities as mentioned previously. In another embodiment, the viscous liquid is capable of being hardened into a backing, such that the material comprises a woven paper fabric having a latex backing positioned on one side.

Paper fabrics are generally woven to a desired specification, thus involving the use of a shuttle loom which can only prepare one fabric at a time. Paper fabrics cannot easily be produced from a long continuous sheet from which smaller fabric can be cut, because cutting would result in frayed edges and loose ends. The paper fabrics can be completely coated with a more durable material, such as a plastic but such a complete synthetic coating can defeat the concept of a product having an all-natural look.

In one embodiment, a paper fabric with woven paper yarns may be made on a wide loom, such as a rigid rapier loom. An advantageous feature of weaving on a wide loom allows the production of a continuous sheet of a fabric. The sheet can be cut into any number of desired shapes having desired dimensions. This method omits the tedious task of preparing each individual fabric to a specified size or shape using a shuttle loom. By the method of the present invention, a large continuous sheet can be prepared and a number of fabrics can be cut from this single sheet. This process speeds up production of fabrics and facilitates the production of a large number of orders for fabrics of different sizes.

As mentioned previously, in one embodiment, paper yarns are prepared by twisting wetted paper. In another embodiment, the weaving occurs immediately after twisting. This embodiment provides consistency of the dimensions of the paper yarns and greatly aids in the formation of a tight weave. When the yarns are still moist, the yarns can retain some flexibility to allow positioning and molding of interwoven yarns closely adjacent each other. In one embodiment, the yarn has a minimum moisture content of at least about 12%, preferably at least about 10% and more preferably at least about 5% immediately prior to weaving.

In another embodiment, the yarns are provided to the loom at a controlled tension. Generally, yarns are packaged as a creel and wound around a dummy beam. The yarn is then pulled over a harness and through a load sensor. The load sensor can be controlled by a programmable logic controller (PLC). The PLC sends a signal to the dummy beam to provide information on a desired tension. The rate that the yarn is provided to the loom can be varied in order to control the tension at a consistent level. This controlled tension provides the consistency of the weave. An inconsistent weave will result in unwanted gaps that will be detrimental to the textile material upon application of the backing.

FIGS. 1A–3A show a drawing of a prior art paper carpet versus some example embodiments of the present invention. In FIG. 1A, prior art fabric 10 comprises a set of yarns in a warp direction 11 and a second set of yarns weft direction 12 where the yarns are relatively thick with a circular mill value of greater than about 6,000. The yarn type and method of producing this fabric results in gaps 13 (shown as shaded areas) that causes fabric 10 to be sufficiently porous and not capable of maintaining even a viscous liquid on only one side. In addition, in the absence of a backing, fabric 10 can suffer fraying along the edges, especially when the edges are cut. To avoid fraying, the prior art paper fabric should be woven to a desired size using a shuttle loom. Due to a thickness of the prior art yarns, the particular weave shown can provide a warp of about 4 ends/in. and a weft of about 9 picks/in. FIG. 1B shows a side view of the prior art fabric. FIG. 1B illustrates how the thickness of the yarns provide gaps 14 which can also allow penetration of a liquid from one side to the other.

Figure 2A:
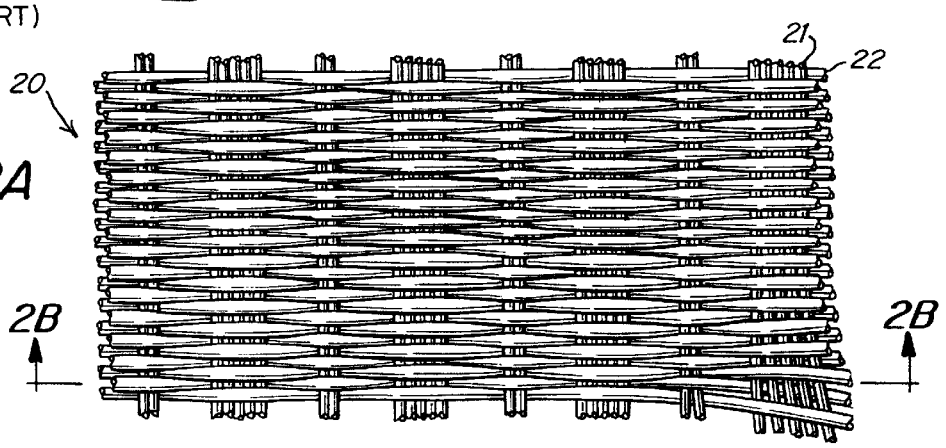
FIG. 2A shows a top view of a paper carpet having a warp of 7 ends/in. and a weft of 17.6 picks/in., drawn to scale.
Figure 2B:
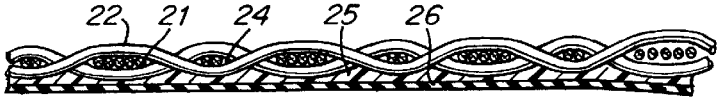
FIG. 2B shows a side view of the carpet of FIG. 2A drawn to scale.
Figure 3A:
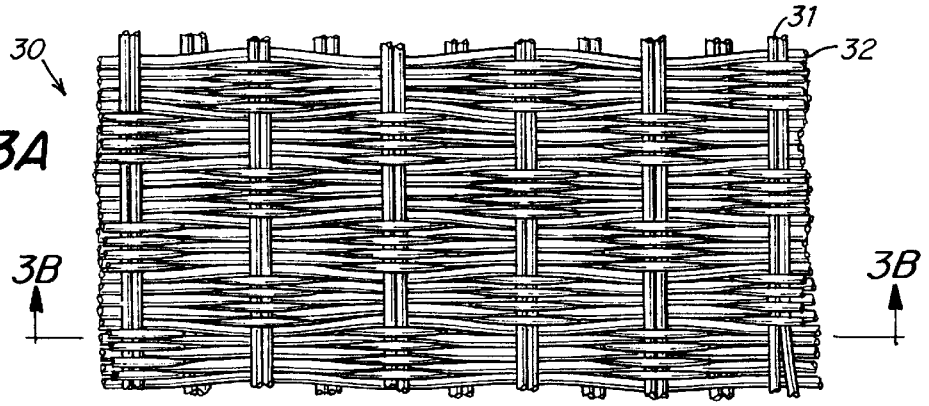
FIG. 3A shows a top view of another paper carpet having a warp of 6 ends/in. and a weft of 24.5 picks/in., drawn to scale
Figure 3B:
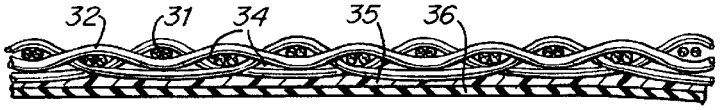
FIG. 3B shows a side view of the carpet of FIG. 3A drawn to scale.

FIGS. 2A and 3A show examples of carpets of the present invention, and FIGS. 2B and 3B show the respective side views. For example, FIG. 2A shows a fabric 20 having warp 21 having a density of 7 ends/in. and weft 22 having density of 17.6 picks/in. Due to a tightness of the weave, there are no gaps corresponding to gap 13 of prior art fabric 10. The tightness is achieved by yarns having a thickness defined by a circular mill value between 4800 and 5800. The side view of FIG. 2B shows only a very minimum gap 24 that is insufficient to allow penetration of a liquid from one side of the carpet to the other. Consequently, backing 25 is positioned on only one side of fabric 20. FIG. 3A shows a similar paper fabric 30 having a warp 31 of 6 ends/in., a weft 32 of 24.5 picks/in and a thickness defined by a circular mill value between 4800 and 5800. As with FIG. 2B, FIG. 3B shows a side view having minimal gaps 34 insufficient to allow penetration of a liquid from one side to the other. Consequently, backing 35 is positioned on only one side of fabric 30. Optionally, laminate layers 26 and 36 can be positioned on backing 25 and 35, respectively. It is understood that the thicknesses of backing 25 and 35 and optional laminate layer 26 and 36 are drawn for illustrative purposes only and are not intended to indicate desired absolute or relative thicknesses.

Figure 4:
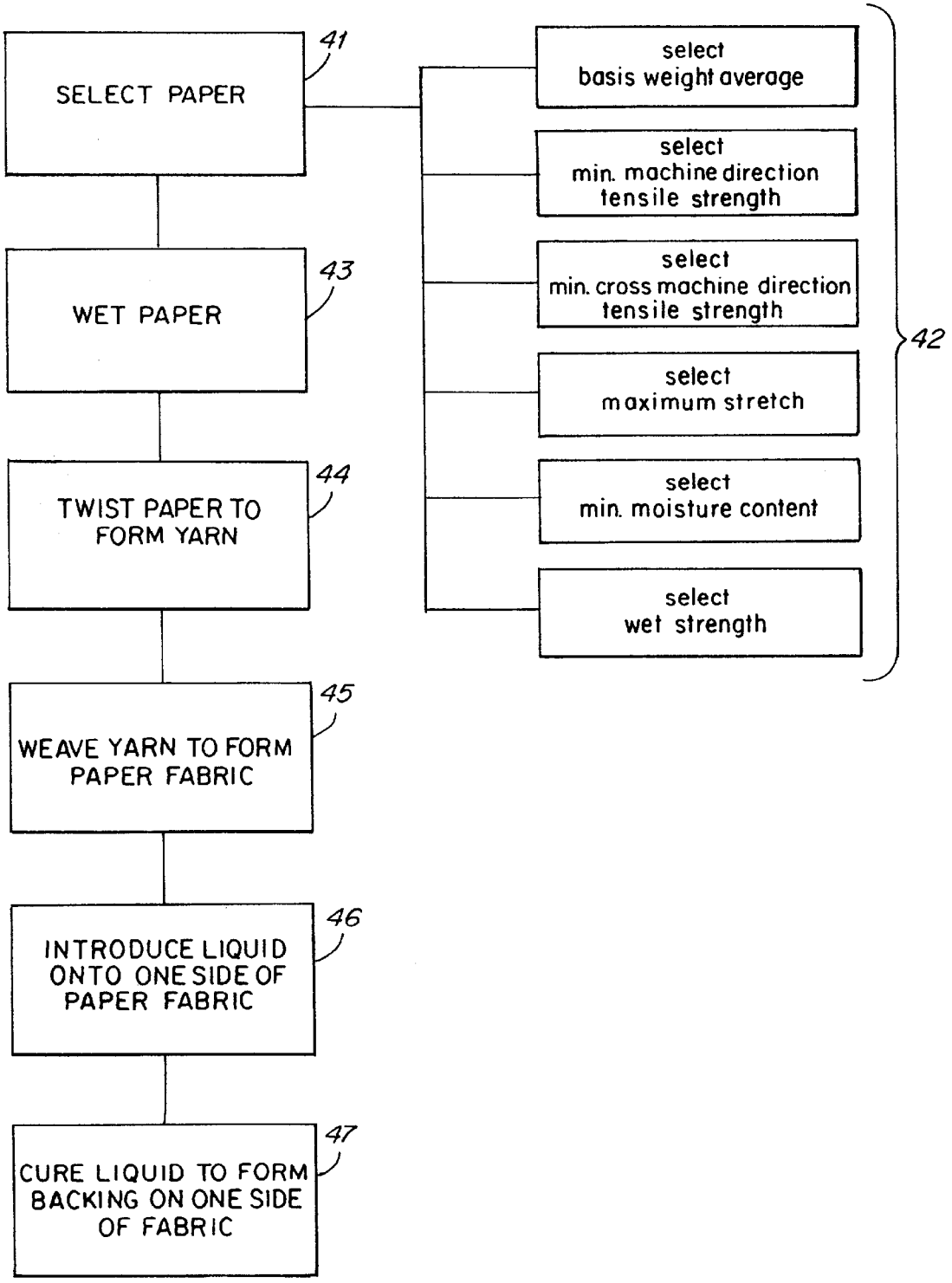
FIG. 4 shows a flowchart for a method of preparing a textile fabric of the present invention.

FIG. 4 is a flowchart for one embodiment of a method of preparing a textile fabric. At step 41, a paper type is selected. As shown at step 42, the selection may be based on a basis weight average, minimum machine direction tensile strength, minimum cross machine direction tensile strength, maximum stretch, minimum moisture content and wet strength, as described previously. At steps 43 and 44, the paper is wetted and twisted to form a yarn. At step 45, the yarn is woven to form a paper fabric. At step 46, a backing is applied to the fabric by introducing a liquid onto one side of the fabric. At step 47, the liquid is cured. This allows a hardened backing to form on the fabric. The resulting product may be cut to a desired shape, such as for a carpet or rug (the term "rug," as used herein, includes carpets).

The function and advantage of these and other embodiments of the present invention will be more fully understood from the examples below. The following examples are intended to illustrate the benefits of the present invention, but do not exemplify the full scope of the invention.

EXAMPLE 1

Yarn Preparation

The paper used in this example is a fibrous, 100% soft wood long fiber pulp having a cellulose content of 50%, a hemicellulose content of 30% and a lignin content of 20%. Other properties of the paper are listed in Table 1.

TABLE 1

| | |
|---|---|
| Basis weight average | 25 lb |
| Minimum machine direction tensile strength | 29.5 lb/in. |
| Minimum cross machine direction tensile strength | 9 lb/in. |
| Maximum stretch | 1.5% |
| Minimum moisture content | 5% |
| Wet strength | 9% |

The paper is wetted by running through a trough. The yarn is twisted on a ring twister. Properties of the yarn are shown in Table 2.

TABLE 2

| | |
|---|---|
| Minimum tensile strength | 17 lb |
| Minimum moisture content | 16–17% |
| Minimum twist | 26 twists/ft |
| Circular mill value | 4800–5800 |

Yarns of various densities can be provided from the specifications of Table. 2. For example, a finer yarn can have a density of 1250 ft yarn/lb of paper, whereas a thicker yarn can have a density of 940 ft yarn/lb paper.

EXAMPLE 2

Fabric Preparation

The yarn of Example 1 is woven on a rigid rapier loom immediately after twisting. At the time of weaving, the yarn has a moisture content of 13%.

The fabric of FIG. 2A has a warp of 7 ends/in. and a weft of 17.6 picks/in. The fabric of FIG. 3A has a warp of 6 yarn/in. and a weft of 24.5 picks/in. From FIGS. 2A and 3A, it can be seen that a variety of fabrics can be produced having different warp and weft densities. A sum of the densities of FIG. 2A is 24.6 yarns/in. and for FIG. 3A the density is 31.5 yarns/in.

EXAMPLE 3

Application of the Backing

The final textile material comprises a backing applied on one side of the fabric. The backing can be applied by injecting a liquid comprising a watery dispersion of a latex precursor. The precursor comprises a blend of natural latex and styrene-butadiene rubber filled with calcium carbonate, dispersing agents, soaps and antioxidants. A vulcanization paste comprising sulfur and zinc oxide and a gelling agent (ammonium acetate) are added to this blend. If desired, percentages of these components can be varied to achieve particular properties. One such backing can be purchased from and by Tasibel NV of Belgium.

After injecting the latex precursor dispersion as a hot melt, the dispersion completely covers one side of the fabric. Approximately one minute after applying the dispersion, the textile material is cured by applying low heat.

The thickness of the backing and an optional laminate layer can be varied as desired, for economic purposes or depending on the particular application of the fabric. For example, a paper fabric for use as a carpet will experience greater wear and tear than a paper wall hanging fabric and accordingly, a thicker backing may be desired for the carpet.

Those skilled in the art would readily appreciate that all parameters listed herein are meant to be examples and that actual parameters will depend upon the specific application for which the methods and apparatus of the present invention are used. It is, therefore, to be understood that the foregoing embodiments are presented by way of example only and that, within the scope of the appended claims and equivalents thereto, the invention may be practiced otherwise than as specifically described.

What is claimed:

1. A textile material, comprising:

a fabric comprising a first set of paper yarns in a warp direction woven with a second set of paper yarns in a substantially perpendicular weft direction; and a backing positioned adjacent one side of the fabric and an opposing side of the fabric free of the backing.

2. The textile material of claim 1, wherein the fabric is tightly woven.

3. The textile material of claim 1, wherein the textile material forms a rug.

4. The material of claim 1, wherein a density of the first set of yarns is at least about 6 ends/in.

5. The material of claim 1, wherein a density of the second set of yarns is at least about 6 picks/in.

6. The material of claim 1, wherein a sum of the density of the first and second sets of yarns is at least about 20 yarns/in.

7. The material of claim 1, wherein the backing comprises a polymeric material.

8. The material of claim 7, wherein polymeric material is a latex.

9. The material of claim 1, wherein the textile material is free of fraying upon cutting.

10. The material of claim 1, further comprising a border positioned along an edge of the material.

11. The material of claim 1, wherein each yarn has a density of less than about 1500 ft/lb paper.

12. The material of claim 1, wherein each yarn has a minimum twist of at least about 20 twists/ft.

13. The material of claim 1, wherein each yarn has a thickness defined by a circular mill value of less than about 6000.

14. The material of claim 1, wherein each yarn has a minimum tensile strength of at least about 15 lb.

15. The material of claim 1, wherein the backing has a viscosity of at least about 1,000 centipoise.

16. The material of claim 15, wherein the backing comprises a polymer.

17. The material of claim 16, wherein the backing comprises a latex.

18. The material of claim 16, wherein the backing comprises a polyalkylene.

19. The material of claim 1, further comprising a laminate positioned against the backing such that the backing is sandwiched between the laminate and the fabric.

20. The material of claim 1, wherein the fabric comprises all-natural components.

21. A method of producing a textile material, comprising:

weaving a first set of paper yarns in a weft direction with a second set of paper yarns in a substantially perpendicular warp direction to form a fabric; and applying a backing to only one side of the fabric.

22. The method of claim 21, wherein the weaving comprises tightly weaving.

23. The method of claim 22, wherein the tightly weaving comprises weaving the yarns with a wide loom.

24. The method of claim 22, wherein the yarns are formed by twisting wetted paper.

25. The method of claim 24, wherein the paper, prior to wetting, has a basis weight average of at least about 20 lb.

26. The method of claim 24, wherein the paper, prior to wetting, has a minimum machine direction tensile strength of at least about 20 lb/in.

27. The method of claim 26, wherein the paper, prior to wetting, has a minimum machine cross-direction tensile strength of at least about 5 lb/in.

28. The method of claim 24, wherein the paper, prior to wetting, has a maximum stretch of less than about 5%.

29. The method of claim 24, wherein the wetted paper has a wet strength of at least about 5%.

30. The method of claim 22, wherein the weaving occurs immediately after twisting the paper.

31. The method of claim 30, wherein the yarn has a minimum moisture content of at least about 5%.

32. The method of claim 22, wherein the applying comprises:

introducing a liquid onto one side of the fabric; and curing the liquid.

33. The method of claim 32, wherein the backing comprises a polymeric material.

34. The method of claim 33, wherein the polymeric material is a latex.

35. The method of claim 32, wherein an opposing side of the fabric is free of the backing.

36. The method of claim 32, wherein the liquid has a viscosity of at least about 50 centipoise.

37. The method of claim 36, wherein the liquid is a polymer precursor.

38. The method of claim 32, wherein the curing comprises a process selected from the group consisting of air-drying, heating, applying a pressure and exposing the liquid to light.

39. The method of claim 32, further comprising cutting the textile material to a desired dimension.

40. The method of claim 39, wherein the textile material is free of fraying.

41. The method of claim 39, further comprising applying a border along at least one edge of the material.

42. The method of claim 32, further comprising cutting the textile material to a desired shape.

43. The method of claim 22, wherein the applying comprises extrusion.

44. A textile material comprising:

tightly woven paper yarns having a polymer precursor positioned on one side of the material and an opposing side of the material free of the precursor.

45. The material of claim 44, wherein the polymer precursor has a viscosity of at least about 50 centipoise.

46. A textile material comprising:

tightly woven paper yarns having a liquid having a viscosity of at least about 50 centipoise positioned on one side of the material and an opposing side of the material free of the liquid.

47. A textile material, comprising:

a woven paper fabric having a latex backing positioned on only one side.

48. A textile material, comprising a tightly woven material, a viscous liquid positioned on one side, and an opposing side free of the viscous liquid.

49. The material of claim 48, wherein the liquid has a viscosity of at least about 50 centipoise.

50. The material of claim 48, wherein the liquid is a precursor of a polymer.

* * * * *